United States Patent [19]

Shaw, III et al.

[11] 4,445,947

[45] May 1, 1984

[54] LOW COST FLUOROCARBON FLARE COMPOSITIONS

[75] Inventors: Graham C. Shaw, III, Garland, Utah; Russell Reed, Jr., Ridgecrest, Calif.

[73] Assignee: Thiokol Corporation, Chicago, Ill.

[21] Appl. No.: 476,684

[22] Filed: Mar. 18, 1983

[51] Int. Cl.[3] ..... C06B 45/10

[52] U.S. Cl. ..... 149/19.3; 149/19.91; 149/116

[58] Field of Search ..... 149/19.3, 19.91, 116, 149/19.1

[56] References Cited

U.S. PATENT DOCUMENTS

| | | | |
|---|---|---|---|
| 3,629,020 | 12/1971 | Kaufman et al. | 149/19.3 |
| 3,640,785 | 2/1972 | O'Drobinak et al. | 149/19.3 |
| 3,732,132 | 5/1973 | Merrow et al. | 149/19.3 |
| 3,753,811 | 8/1973 | Julian et al. | 149/19.3 |
| 3,770,525 | 11/1973 | Villy-Desmeserets et al. | 149/116 |
| 3,983,816 | 10/1976 | Cornia et al. | 149/116 |
| 4,023,995 | 5/1977 | Reed et al. | 149/19.3 |

FOREIGN PATENT DOCUMENTS

| | | | |
|---|---|---|---|
| 741853 | 5/1970 | Belgium | 149/19.3 |

OTHER PUBLICATIONS

Hawley, "The Condensed Chemical Dictionary," 9th Ed., pp. 391, 700–701 and 749, Van Nostrand Reinhold Co. (1977), New York.

*Primary Examiner*—Edward A. Miller

*Attorney, Agent, or Firm*—Gerald K. White; George F. Wheeler

[57] ABSTRACT

A low cost infrared flare composition which uses a high molecular weight fluorinated resin, a low molecular weight fluorinated resin, a polymerizing solvent, and an initiator to form a binder which is combined with a reducing agent to yield a composition readily processable into various grain shapes and varying degrees of hardness thereby providing more consistent burning rates.

15 Claims, No Drawings

LOW COST FLUOROCARBON FLARE COMPOSITIONS

The invention described herein may be manufactured and used by or for the Government of the United States of America for governmental purposes without the payment of any royalties thereon or therefor.

BACKGROUND OF THE INVENTION

1. Field of the Invention

The present invention relates to infrared flares, and more particularly, to infrared flare compositions which employ readily available fluorocarbon resins in the formation of the binder.

2. Description of the Prior Art

Fluorocarbon-magnesium mixtures are widely used in infrared flares since the reaction $$(CF_2)+Mg \rightarrow MgF_{2(g)}+C_{(S)}$$

is high in enthalpy release, and produces carbon which emits strongly in the 1–2 micron region. Current flare compositions generally employ polytetrafluoroethylene or a mixture of polytetrafluoroethylene and vinylidene fluoride-hexafluoropropylene copolymer as the fluorocarbon material, such that the compositions must generally be pressed or extruded. Pressing and extrusion are less desirable than casting because they cannot be conveniently used to manufacture center perforate grains, nor grains of large or irregular shapes. Moreover, pressed charges burn more rapidly and less reproducibly than cast or tamp-cast compositions in which the binder wets the solid material. Pressing, and to a lesser extent extrusion, may also alter the particle size of crystalline ingredients, such as an oxidizer, in a non-uniform fashion.

The known curable liquid fluorocarbon binders are extremely expensive and are only available in very limited quantities. Thus, systems which employ such binders have had very limited use.

Accordingly, a need exists for a composition which is either pour-castable, i.e., it has a viscosity of less than $5\times10^5$ centipoise, or is more readily used than the prior art as a cast-moldable or tampable composition, is curable to a shaped flare candle at moderately elevated temperatures, and yet is simple and inexpensive to produce.

Various flare compositions are known in the prior art which employ high molecular weight copolymers of vinylidene fluoride and hexafluoropropylene as a part of the matrix binder in conjunction with another material. However, such compositions either use chlorinated compounds which reduce the fluorine content, or use expensive and difficult to obtain fluorocarbon monomers in the formation of the binder. Typical of such prior art are the compositions described in U.S. Pat. Nos. 3,983,816; 3,640,785; 3,629,020; and 3,770,525. In addition, numerous patents discuss the use of copolymers of vinylidene fluoride and hexafluoropropylene, including U.S. Pat. Nos. 3,765,334; 3,732,132; and 3,734,788.

SUMMARY OF THE INVENTION

The present invention is an infrared flare composition comprising: (a) from about 35 to about 60 percent by weight of a reducing agent which is magnesium, aluminum, or a mixture thereof; (b) from about 7 to about 20 percent by weight of a polymerizing solvent; (c) an effective amount of a free radical initiator; and (d) from about 26 to about 60 percent by weight of a two-part fluorocarbon resin system comprising: (i) a high molecular weight fluorinated resin, said resin containing between about 55 and about 76 percent by weight of fluorine, said fluorinated resin having a limited solubility in the polymerizing solvent; and (ii) a low molecular weight fluorinated resin, said resin containing between about 55 and about 76 percent by weight of fluorine, said fluorinated resin being substantially completely soluble in the polymerizing solvent.

The two-part fluorocarbon resin system is used in conjunction with a polymerizing solvent which is preferably a lower alkyl acrylate or methacrylate. The concentration range of the polymerizing solvent is chosen to provide an amount which completely dissolves the low molecular weight fluorinated resin, but only partially dissolves the high molecular weight fluorinated resin.

The resulting composition is used in conjunction with a reducing compound to produce an infrared flare composition. The composition possesses a desirably high fluorine content while at the same time retaining a relatively low viscosity. In preferred embodiments, the composition can be poured, i.e., has a viscosity of less than $5\times10^5$ centipoise, and then cured to produce a substantially homogeneous, tough elastomeric binder. Even when the ingredients of the composition are used in amounts which provide a composition too viscous for pouring, the composition is still more readily used as a cast-moldable or tampable composition than prior art compositions, while still providing a substantially homogenous, tough elastomeric binder.

In preferred embodiments, the high molecular weight fluorinated resin is a copolymer of vinylidene fluoride and hexafluoropropylene having a molecular weight of between about 50,000 and about 70,000; the low molecular weight fluorinated resin is also a copolymer of vinylidene fluoride and hexafluoropropylene although having a molecular weight of from about 2,000 to about 3,000; and the polymerizing solvent is a lower alkyl acrylate or methacrylate.

The resulting composition is processable into grains of varied shapes with the mechanical properties of the grains varying from hard semi-rigid grains to softer flexible grains. The use of the compositions of the present invention results in consistent burning rates over wider ranges of composition.

DESCRIPTION OF THE PREFERRED EMBODIMENTS

The composition of the present invention includes essentially five components: a high molecular weight fluorinated resin, a low molecular weight fluorinated resin, a polymerizing solvent, a free radical initiator, and a reducing agent.

The high molecular weight fluorinated resin acts as a plasticizer in the cured solvent matrix, thereby providing a composition with good mechanical properties. However, the high molecular weight fluorinated resin has a limited solubility in the polymerizing solvent, with increasing amounts of resin resulting in a rapidly increasing viscosity. Thus the low molecular weight fluorinated resin is used to allow more resin to be dissolved in the polymerizing solvent than would be possible if only high molecular weight fluorinated resin were used. This allows the total fluorine content to be increased without unduly raising the viscosity. The polymerizing solvent used in the present invention dissolves a portion of the high molecular weight fluorinated resin while suspending the remainder of the high molecular weight fluorinated resin. At the same time, the polymerizing solvent substantially completely dissolves the low molecular weight fluorinated resin.

The compositions of the present invention use a reducing agent of magnesium, aluminum, or mixtures of aluminum and magnesium. The reducing agent is used at about 35 to about 60% by weight of the total flare composition. Magnesium is the preferred reducing agent.

To provide an appropriate fluorine content, the composition of the present invention contains the two-part fluorocarbon resin system at from about 26 to about 60 percent by weight. The high molecular weight fluorinated resin and the low molecular weight fluorinated resin are used in combination to provide a composition which has a desirably high fluorine content while also providing a composition which is readily processable into grains of varied shapes. If the high molecular weight fluorinated resin is used alone in a flare composition at between about 26 and about 60 percent by weight without the low molecular weight fluorinated resin while the other ingredients of the present invention are used at their recited levels, only a portion of the high molecular weight fluorinated resin, about 15 to 20 percent by weight of the total flare composition, would dissolve before undesirably high viscosities would be experienced. Any increase in the amount of solvent would result in an undesirable reduction in fluorine content and would only succeed in dissolving more high molecular weight fluorinated resin with a concomitant increase in viscosity. By substituting the low molecular weight fluorinated resin for a portion of the high molecular weight fluorinated resin, the total fluorine content in the flare composition can be maintained at a desirably high level while still obtaining a readily workable binder. In fact, the use of the low molecular weight fluorinated resin which substantially completely dissolves in the polymerizing solvent without a substantial increase in viscosity, allows the use of increased levels of the high molecular weight fluorinated resin. In the present invention, a portion of the high molecular weight fluorinated resin is dissolved in the polymerizing solvent while the remainder is suspended. The suspended portion of the high molecular weight fluorinated resin swells during the curing process to yield a largely homogeneous tough elastomeric binder. By varying the ratio of high molecular weight fluorinated resin to low molecular weight fluorinated resin, the hardness of the cured grain can be varied from hard semi-rigid grains to softer flexible grains. To ensure that a substantial portion of the high molecular weight resin is suspended rather than dissolved, it is preferred that the composition be processed and cured within a short time after its preparation, preferably within about 2 hours. Longer periods are acceptable but the viscosity may increase somewhat if the composition is allowed to stand for a long period before curing.

The high molecular weight fluorinated resin of the present invention can be a fluorinated acrylate, polyester, or polyurethane, such as copolymers formed from a mixture of vinylidene fluoride and hexafluoropropylene. The fluorine content of such compounds should be between about 55 and about 76 weight percent. A preferred high molecular weight fluorinated resin is VITON A (a trademark of DuPont for a copolymer of vinylidene fluoride and hexafluoropropylene having a molecular weight of about 60,000, and a fluorine content of about 66 weight percent). A similar copolymer in FLUOREL (a tradename for hexafluoropropene vinylidene fluoride). TEFLON 100X (trademark of DuPont) which is made by copolymerizing tetrafluoroethylene with hexafluoropropylene may also be used. Other binders which may be used include KEL-F, a homopolymer of chlorotrifluoroethylene and KEL-F elastomer, a copolymer of chlorotrifluoroethylene and vinylidene fluoride. Essentially any fluorinated resin having a fluorine content within the above range and having a high enough molecular weight to provide a limited solubility in the polymerizing solvent, preferably between about 50,000 and about 70,000, may be used. In compounds where a portion of the substitution is other than fluoro (e.g., chloro), the fluorine content is not as high, and is thus less desirable for use in the present invention. The high molecular weight component is preferably used as between about 9 and about 34 percent by weight.

The second part of the two-part resin system is a low molecular weight fluorinated resin which is substantially completely soluble in the polymerizing solvent when the polymerizing solvent is used within the recited range of about 7 to about 20 percent by weight. Preferably, the low molecular weight fluorinated resin has a molecular weight between about 2,000 and about 3,000 and is preferably used at between about 16 and about 37% by weight. By readily dissolving in the polymerizing solvent without an undue increase in viscosity, the low molecular weight fluorinated resin allows the high molecular weight fluorinated resin to be used in larger amounts than would be possible if the high molecular weight fluorinated resin was used alone, thus allowing as much as a 10–20% increase in the amount of fluorine in the flare without unduly increasing the viscosity.

A preferred low molecular weight fluorinated resin is a copolymer of vinylidene fluoride and hexafluoropropylene sold under the trademark VITON LD227 (trademark of DuPont) having a molecular weight of about 2,500, and a fluorine content of about 66 weight percent. However, other low molecular weight compounds having a fluorine content of between about 55 and about 76 weight percent, and which are substantially completely soluble in the polymerizing solvent can also be used in the practice of the present invention. It is preferred that the high molecular weight fluorinated resin and the low molecular weight fluorinated resin be composed of the same monomeric units.

The polymerizing solvent of the present invention is used at between about 7 to about 20% by weight. Although various liquids are known to those skilled in the art which can serve as the polymerizing solvent, from the viewpoint of cost and availability, lower alkyl ($C_1$ to $C_4$) acrylates and methacrylates are preferred. Preferred solvents are methyl acrylate, propyl methacrylate, and propyl acrylate, with methyl methacrylate being particularly preferred.

The composition also includes a free radical initiator, any of those well known in the art being suitable for use in the present invention. The initiator is conveniently added to the composition as a part of the solvent at a concentration effective to result in the polymerization of the polymerizing solvent during the curing process, typically about 0.01 to about 2.0 percent by weight of the polymerizing solvent. A particular preferred initiator is benzoyl peroxide, one of the advantages of benzoyl peroxide being its favorable half-life. However, other compounds such as azobisiso-butyronitrile, various persulfates and other peroxides can also be used.

The ingredients making up the binder can be combined and mixed in essentially any order followed by the addition of the reducing agent. However, it is preferred that the high molecular weight fluorinated resin be ground first before being mixed with a previously prepared solution of the polymerizing solvent, initiator, and low molecular weight fluorinated resin. The reducing agent would then be dispersed in the binder by various methods well known to those skilled in the art such as by using a pyrotechnic mixer.

In order to further illustrate the present invention and the advantages thereof, the following specific examples are given, it being understood that these examples are intended only to be illustrative without serving as a limitation on the scope of the present invention.

EXAMPLES A–B and 1–6

In the following examples, the VITON A is first ground in a Waring Blender, followed by the addition and mixing of a previously prepared solution of methyl methacrylate, initiator, and VITON LD227. After obtaining a relatively homogeneous composition, the magnesium is added and dispersed throughout the binder system. The resulting liquid composition is then treated as indicated under the designation "Casting Method". By "pourcast" is meant a liquid composition which is poured into a mold and then cured. "Cast-molded" refers to a composition which will have a viscosity intermediate between pour-cast and tamped, i.e., of a viscosity which would be useful for extrusion. In a cast-molded composition, the composition is added to the mold and then sufficient force is applied to ensure that substantial air pockets are not present. The "tamped" compositions are placed in a mold and then tamped, e.g. with an air hammer. Examples A and B are provided for comparison with Examples 1–6 of the present invention, Example A illustrating a composition in which VITON A is used alone without VITON LD227 or polymerizing solvent, and Example B illustrating a composition in which a flare composition is formed without the polymerizing solvent. Examples A and B were pressed, a method of the prior art in which high pressures are used in forming the flare composition. The amount of each ingredient in Table I is the amount in percent by weight.

TABLE I

| Example | A | B | 1 | 2 |
|---|---|---|---|---|
| Viton A | 44.83 | 23.20 | 25.0 | 33.6 |
| Viton Wax (LD227) | — | 23.20 | 25.0 | 16.4 |
| Methyl Methacrylate* | — | — | 8.6 | 8.6 |
| Nitrocellulose | 2.54 | — | — | — |
| Mg | 52.63 | 52.63 | 41.4 | 41.4 |
| MgO | — | 1.00 | — | — |
| Casting Method | pressed | pressed | pour-cast | tamped |
| Shore A Hardness of cured grain | 35 | 61 | 76 | 80 |

| Example | 3 | 4 | 5 | 6 |
|---|---|---|---|---|
| Viton A | 12.1 | 9.1 | 16.4 | 21.5 |
| Viton Wax (LD227) | 33.6 | 36.6 | 33.6 | 20.5 |
| Methyl Methacrylate* | 12.9 | 12.9 | 8.6 | 10.0 |
| Nitrocellulose | — | — | — | — |
| Mg | 41.4 | 41.4 | 41.4 | 48.0 |
| MgO | — | — | — | — |
| Casting Method | pour- | pour- | pour- | cast- |

TABLE I-continued

| | cast | cast | cast | molded |
|---|---|---|---|---|
| Shore A Hardness of cured grain | 90 | 88 | 53 | 70 |

*Contains benzoyl peroxide at approximately 1% w/w of the methyl methacrylate.

As can be seen from the results in Table I, the cured grains resulting from the composition of the present invention can vary over a wide range of Shore A Hardness from hard semi-rigid grains such as that of Example 3 to softer flexible grains such as that of Example 5. In addition to the pour-castable compositions of Examples 1 and 3–5, it should be noted that the present invention can also provide a tampable composition if desired, such as in Example 2 or a cast-moldable composition as in Example 6.

While the invention has been described in terms of various preferred embodiments, one skilled in the art will appreciate that various modifications, substitutions, omissions, and changes may be made without departing from the spirit thereof. Accordingly, it is intended that the scope of the present invention be limited solely by the scope of the following claims.

What is claimed is:

1. An infrared flare composition comprising:

(a) from about 35 to about 60 percent by weight of a reducing agent which is magnesium, aluminum, or a mixture thereof;

(b) from about 7 to about 20 percent by weight of a free radical polymerizable solvent;

(c) an effective amount of a free radical initiator; and (d) from about 26 to about 60 percent by weight of a two-part fluorocarbon polymer system comprising:

(i) a high molecular weight fluorocarbon polymer, said polymer containing between about 55 and about 76 percent by weight of fluorine and having a limited solubility in the polymerizing solvent; and (ii) a low molecular weight fluorocarbon polymer, said polymer containing between about 55 and about 76 percent by weight of fluorine and being substantially completely soluble in the polymerizing solvent.

2. The composition of claim 1 wherein the polymerizable solvent is a lower alkyl acrylate or methacrylate, or mixtures thereof.

3. The composition of claim 1 wherein the polymerizable solvent is methyl methacrylate.

4. The composition of claim 1 wherein the high molecular weight polymer is present at between about 9 and about 34 percent by weight and has a molecular weight of between about 50,000 and about 70,000.

5. The composition of claim 1 wherein the low molecular weight polymer is present at between about 16 and about 37 percent by weight and has a molecular weight of between about 2,000 and about 3,000.

6. The composition of claim 1 wherein each polymer of the two part polymer system is made from the same monomeric units.

7. The composition of claim 1 wherein each polymer of the two-part polymer system is a copolymer of vinylidene fluoride and hexafluoropropylene.

8. The composition of claim 1 wherein the reducing agent is magnesium.

9. The composition of claim 1 wherein the free radical initiator is benzoyl peroxide.

10. The composition of claim 1, wherein the composition has a viscosity of less than $5\times10^5$ centipoise.

11. An infrared flare composition comprising:

(a) from about 35 to about 60 weight percent by weight of a reducing agent which is magnesium, aluminum, or a mixture thereof;

(b) from about 7 to about 20 percent by weight of a lower alkyl acrylate or methacrylate, or a mixture thereof;

(c) an effective amount of a free radical initiator; and (d) from about 26 to about 60 percent by weight of a two-part fluorocarbon polymer system comprising:

(i) from about 9 to about 34 percent by weight of a fluorocarbon polymer having a fluorine content between about 55 and about 76 percent by weight and a molecular weight between about 50,000 and about 70,000; and (ii) from about 16 to about 37 percent by weight of a fluorocarbon polymer having a fluorine content between about 55 and about 76 percent by weight and a molecular weight between about 2,000 and about 3,000.

12. The composition of claim 11 wherein each polymer of the two-part system is a copolymer of vinylidene fluoride and hexafluoropropylene.

13. The composition of claim 11, wherein the composition has a viscosity of less than $5\times10^5$ centipoise.

14. The cured composition of claim 1.

15. The cured composition of claim 11.

* * * * *